United States Patent [19]

Willert

[11] 3,947,901

[45] Apr. 6, 1976

[54] HANGER FOR TOILET BOWL DEODORANT

[75] Inventor: August W. Willert, Ladue, Mo.

[73] Assignee: Irwin-Willert Company, St. Louis, Mo.

[22] Filed: Aug. 25, 1972

[21] Appl. No.: 283,723

[52] U.S. Cl. ..... 4/231

[51] Int. Cl.[2] ..... E03D 9/02

[58] Field of Search ..... 4/1, 97, 109, 121, 228, 4/231, 125, 126; 248/339, 360

[56] References Cited

UNITED STATES PATENTS

| | | | |
|---|---|---|---|
| 3,094,806 | 6/1963 | Rodrigo | 248/360 |
| 3,217,338 | 11/1965 | Wilson | 4/231 |
| 3,290,699 | 12/1966 | Weinstein | 4/231 |
| 3,604,021 | 9/1971 | Nolte, Jr. | 4/231 |

*Primary Examiner*—Richard E. Aegerter
*Assistant Examiner*—Stuart S. Levy
*Attorney, Agent, or Firm*—Rogers, Eilers & Howell

[57] ABSTRACT

A hanger for a toilet bowl deodorant block, the hanger comprising a unitary molded plastic frame having two downwardly converging arms with prongs and serrations at their ends embedded in the block. Above the block the arms extend forwardly, then upwardly and outwardly, and merge into horizontally-disposed bars that can rest across the top of the rim of the bowl. The rear ends of the cross bars merge into downwardly-converging arms joined in a rounded V-shaped web which is bent inwardly opposite the forwardly-sloping portion of the first-named arms to provide a clamping effect that can engage the bowl under the rim preventing accidental lifting of the hanger off the bowl rim and at the same time engaging the outside of the bowl in a single point contact with resilience that minimizes wobble of the hanger.

4 Claims, 5 Drawing Figures

HANGER FOR TOILET BOWL DEODORANT

BACKGROUND OF THE INVENTION

Heretofore hangers of this type have lacked the stabilizing effect of having the arms to which the paradichlorobenzene block is fastened, converging downwardly as well as having serrations and prongs on the ends. Sometimes they have been made of material that had to be bent after it was cut out with a consequent weakening. Some of them have had the rearward arms either separate and disconnected from each other or joined by a horizontal cross bar. This has the disadvantage that it is unstable in its engagement with the rounded outside of a bowl. Some have been made of metal wire which is less resilient, less capable of springing out over the rim of the bowl, yet snapping back in to engage the bowl, and is more corrosive and more likely to stain the bowl.

The objects of the invention are to improve on the deficiencies above mentioned and to provide an inexpensive, strong, satisfactory hanger that will securely hold a paradichlorobenzene block, which is resistant to corrosion, which does not require any forming operation other than molding and which has a secure wobblefree engagement with the bowl when the hanger is installed in place. Other objects and advantages will appear from the description to follow.

IN THE DRAWING

DESCRIPTION OF THE PREFERRED EMBODIMENT

Figure 1:
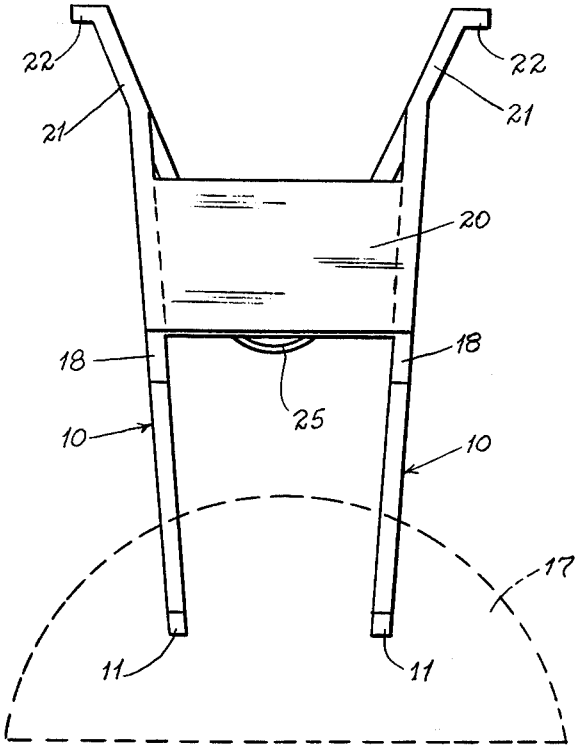
FIG. 1 is a front elevation of the hanger, the deodorizer block being shown in dotted lines.
Figure 2:
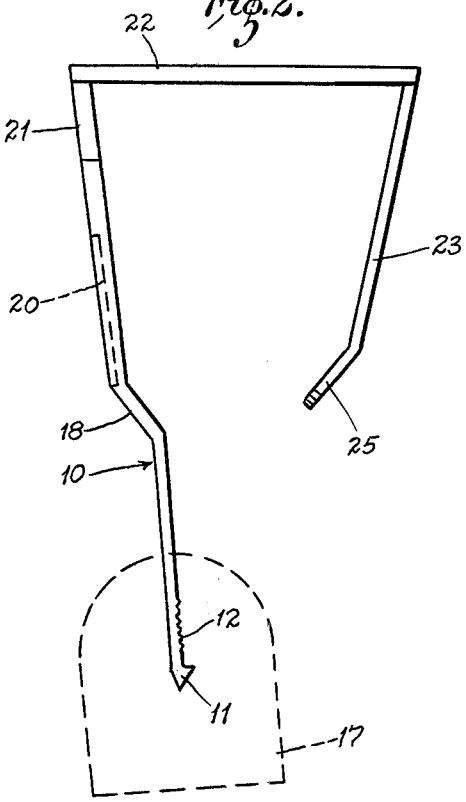
FIG. 2 is a side elevation, the block being shown in dotted lines.

The hanger comprises a unitary plastic frame molded from a plastic material such as a high density polyethylene. It has two depending converging legs generally designated at 10, each having a prong 11 on its end. Adjacent the prongs the legs have serrations 12. A block 17 of paradichlorobenzene is molded or pressed onto the two legs 10, the prongs and serrations aiding in holding it against falling off.

As seen, the legs 10 extend upwardly and outwardly. At 18, the legs are more abruptly bent out, to aid the hanger in engaging around the rim of the toilet bowl. The legs are joined adjacent and above the bends 18 by a web 20 that strengthens them and holds them in spaced position. Above the web 20 they continue upwardly and forwardly and then are flared laterally as shown at 21. The portions 21 are connected at their top ends with horizontal bars 22.

Figure 3:
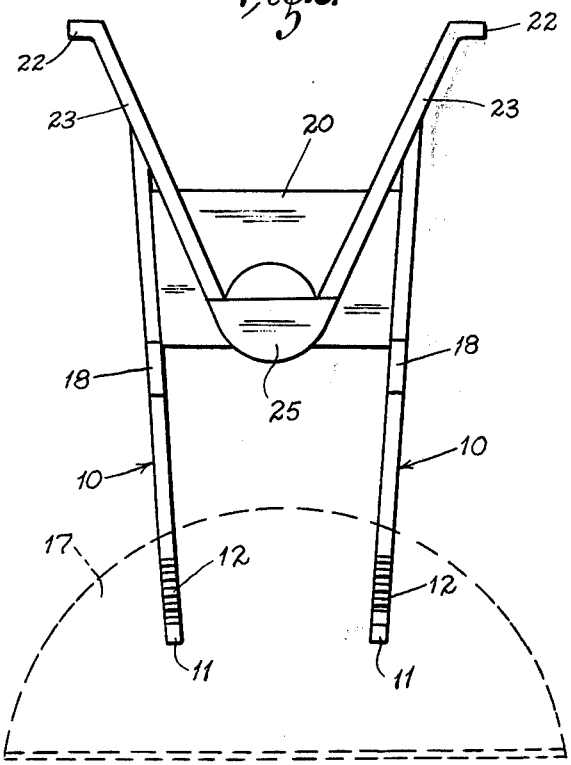
FIG. 3 is a rear elevation, the block being shown in dotted lines.
Figure 4:
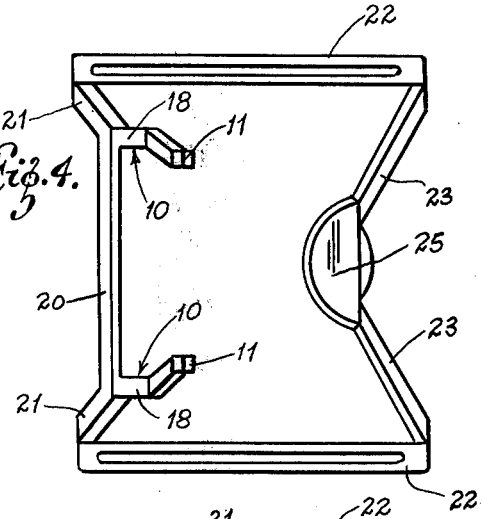
FIG. 4 is a bottom view of the hanger.

The bars 22, constituting the upper support means, preferably grooved as shown in FIG. 4, extend laterally outward at their forward ends, then rearwardly parallel to each other, then laterally inward to merge with the two downwardly converging arms 23 that are joined in a V-arrangement. These arms 23 not only converge laterally but also are bent forwardly toward the arms 10. At their lower ends these arms are joined together in a web 25 that has a rounded and inwardly bent bottom as shown particularly in FIGS. 1, 3 and 4.

Figure 5:
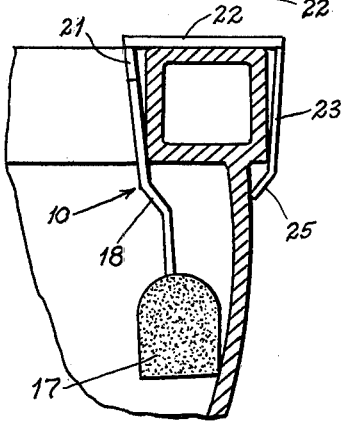
FIG. 5 is a reduced-size partly sectional view of the hanger and block in a toilet bowl.

This entire hanger is molded of plastic material as a unit into the shape illustrated, so that it is very light in weight and is somewhat flexible. The arms 10 and 23 are sufficiently resilient that they may be spread apart from each other to enable the device to be forced over the edge of a toilet bowl as shown in FIG. 5, and thereafter to spring toward each other in a clamping engagement. When so installed, the arms 10 diverge upwardly laterally and then are bent forwardly at 18 and finally upwardly so that they can extend around the upper rim of the bowl. The bars 22 rest upon the top of this rim to support the entire hanger. The arms 23 extend downwardly outside the rim and around the same. Because the web 25 is disposed forwardly and downwardly, it can extend under the rim of the bowl and engage the outside of the bowl below the rim, and by the resilience of the arms 10 and 23, can exert a clamping effect. In this action, the sloping portions 18 on the arms 10 and the inturned end on the web 25 underlie the rim of the bowl to resist inadvertent uplifting of the hanger from the bowl.

An advantage of this arrangement over prior arrangements is that there is substantially a point contact between the rounded web 25 and the outside of the bowl, which enables the device to be installed anywhere on the rim of the bowl, and gives a steadier mounting than where the connecting member is a horizontal bar that tends to wobble on the rounded surface of the bowl.

The legs 10 diverge upwardly, so that there is less likelihood for the block 17 to come loose. The prongs 11 and the serrations 12 also aid in preventing the block from falling off. The downward lateral convergence of the arms 10 and 23 also enables the arms to be close together within the block 17, and so both are embedded in the larger part of the block. But by being separated further at the top, the horizontal bars engage the bowl at points spaced apart sufficiently to minimize wobble of the hanger in use.

Various changes and modifications may be made within this invention as will be readily apparent to those skilled in the art. Such changes and modifications are within the scope and teaching of this invention as defined by the claims appended hereto.

What is claimed is:

1. In a hanger for a toilet bowl disinfectant or the like: a frame having support means to engage a rim of a toilet bowl to support the hanger thereon; a pair of laterally spaced forward legs depending from the support means, converging laterally and downwardly and having their lower portions offset rearwardly, the legs being adapted to hold a deodorant or like block; rearward leg means comprising a pair of legs having laterally spaced upper ends connected to the support means, the rearward legs depending from the support means in spaced relation to the first-named pair of legs, the rearward leg means converging downwardly to substantial intersection and being joined at the lower end thereof by a web that is bent forwardly to extend toward the aforesaid pair of legs; the frame being resilient to enable its installation over the rim of a toilet bowl, the offset in the pair of forward legs and the forward bend of the web of the rearward leg means providing a clamping effect engaging the rim of the bowl, the forwardly bent portion of the web having its end shaped to give substantially a point contact with the bowl.

2. In the hanger of claim 1, the lower ends of the legs of the pair having prongs and serrations.

3. In the hanger of claim 1, the bent portion of the web having a rounded lower end.

4. In the hanger of claim 1, the pair of legs and the leg means converging downwardly toward each other.

* * * * *